US007614980B2

(12) United States Patent
Briones et al.

(10) Patent No.: US 7,614,980 B2
(45) Date of Patent: Nov. 10, 2009

(54) MARTIAL ARTS DEVICE

(76) Inventors: Berta M. Briones, 29099 Fairmount Blvd., Pepper Pike, OH (US) 44124; Steven J. Torontali, 3889 Wiltshire Rd., Moreland Hills, OH (US) 44022

( * ) Notice: Subject to any disclaimer, the term of this patent is extended or adjusted under 35 U.S.C. 154(b) by 58 days.

(21) Appl. No.: 11/318,829

(22) Filed: Dec. 27, 2005

(65) Prior Publication Data

US 2006/0160671 A1 Jul. 20, 2006

Related U.S. Application Data

(60) Provisional application No. 60/639,424, filed on Dec. 27, 2004.

(51) Int. Cl.
*A63B 69/22* (2006.01)
*A63B 69/34* (2006.01)

(52) U.S. Cl. ..... 482/87; 482/83

(58) Field of Classification Search ..... 482/83–90, 482/148, 904; 473/441–445
See application file for complete search history.

(56) References Cited

U.S. PATENT DOCUMENTS

| | | | | |
|---|---|---|---|---|
| 4,046,362 | A | 9/1977 | Spillers | |
| 4,295,646 | A | 10/1981 | Squire | |
| 4,572,504 | A | 2/1986 | DiBartolo | |
| 4,732,378 | A | 3/1988 | LeFebvre et al. | |
| 4,757,989 | A | 7/1988 | Bauer, Jr. | |
| 4,787,625 | A | 11/1988 | Chaloux | |
| 4,817,941 | A | 4/1989 | McCorry | |
| 4,889,334 | A | 12/1989 | Partlo | |
| 5,131,896 | A | 7/1992 | Hutchings | |
| 5,196,249 | A | 3/1993 | Svehaug | |
| 5,204,151 | A | 4/1993 | Svehaug | |
| 5,277,679 | A | 1/1994 | Wells | |
| 5,415,371 | A * | 5/1995 | Kirchner | 248/316.4 |
| 5,458,551 | A * | 10/1995 | Shenton | 482/83 |
| 5,567,496 | A | 10/1996 | Svehaug | |
| 5,665,035 | A * | 9/1997 | Tumminia | 482/83 |
| 6,149,553 | A * | 11/2000 | Antoszewski | 482/83 |
| 6,217,490 | B1 * | 4/2001 | Wurtak | 482/83 |
| 6,736,764 | B1 | 5/2004 | Kapustka | |
| 2004/0005963 | A1 | 1/2004 | Tudor | |
| 2004/0176222 | A1 | 9/2004 | Mitchell | |

(Continued)

OTHER PUBLICATIONS

UMAB: "The Ultimate Martial Arts Board," Dec. 8, 2004, p. 1, (located at www.umab.com).

(Continued)

*Primary Examiner*—Fenn C Mathew
(74) *Attorney, Agent, or Firm*—Benesch, Friedlander, Coplan & Aronoff LLP

(57) ABSTRACT

Devices for supporting and/or positioning a martial arts board, or other strikeable object, are described. In one embodiment, the device includes a frame and a support assembly securing the board to the frame. The support assembly may include a pivotal retainer to facilitate rapid insertion and securing of a martial arts board by the device. In one embodiment, the device includes a rotational assembly configured to rotate the martial arts board and/or a tiltable assembly configured to tilt the martial arts board at an angle. Rotation and tilting may facilitate positioning of the board so that an individual is able to strike the board. In another embodiment, the device is modular and may be disassembled for transportation or storage.

14 Claims, 8 Drawing Sheets

U.S. PATENT DOCUMENTS

2004/0180762 A1 9/2004 Phillips

OTHER PUBLICATIONS

UMAB: "The Ultimate Martial Arts Board," Dec. 8, 2004, p. 1, (located at www.umab.com/intro.php).

MartialArtSupply.com: "Rebreakable Boards," Dec. 8, 2004, pp. 1 & 2, (located at www.martialartsupply.com/Training_Gear/Striking_Bags/Rebrakeable_Board/rebreakable_board.html).

* cited by examiner

MARTIAL ARTS DEVICE

PRIORITY

This application claims priority to U.S. provisional application Ser. No. 60/639,424, filed Dec. 27, 2004.

FIELD OF INVENTION

The present application relates to a martial arts support device. In particular, the present application relates to a martial arts support device configured to secure an object for a user to strike with hands or feet.

BACKGROUND

In some of the martial arts, an individual may strike an object with the purpose of breaking the object. For example, in tae kwon do, an individual may strike a board with the hands or feet and break the board. The board may be held by a first individual in a position where a second individual may strike and break the board. In this situation, the individual holding the board could be injured by a striking force applied to the board by the second individual. The individual holding the board could also be injured if the second individual misses the board and instead strikes the individual holding the board. Also, the individual attempting to strike the board could be injured if that individual misses the board and strikes another object.

Devices have been developed that support strikeable martial arts objects, like boards, in positions suitable for an individual to strike the object. These devices may generally eliminate the need for an individual to hold these objects and, thus, eliminate injuries that might occur to individuals holding the objects.

BRIEF DESCRIPTION OF THE DRAWINGS

In the accompanying drawings, structures are illustrated that, together with the detailed description provided below, describe exemplary embodiments of the claimed invention.

In the drawings and description that follows, like elements are identified with the same reference numerals. The drawings are not to scale and the proportion of certain elements may be exaggerated for the purpose of illustration.

DETAILED DESCRIPTION

Figure 1B:
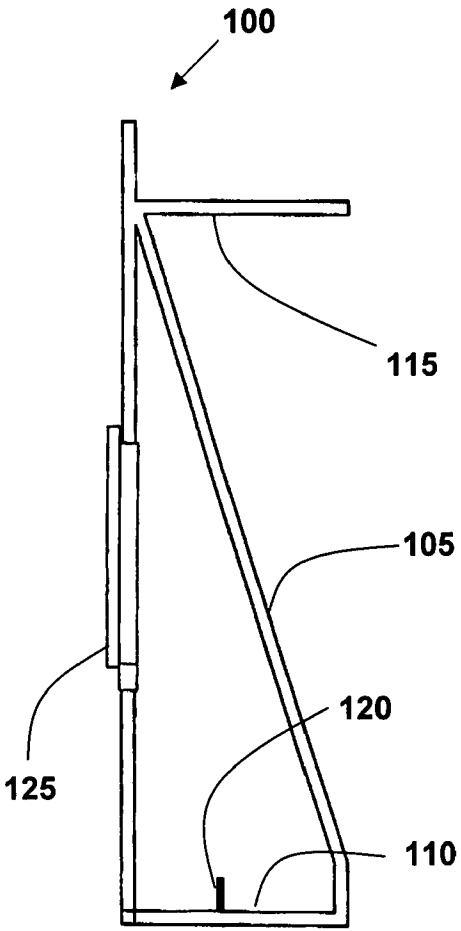
FIGS. 1A, 1B illustrate front and side views, respectively, of one embodiment of a martial arts device.

This application describes martial arts board support devices. In one embodiment, a martial arts board support device includes a frame and a support assembly attached to the frame. The frame extends upward from a base that rests on the floor. The support assembly is generally configured to secure a strikeable martial arts object, like a board, to the device.

In one embodiment, the support assembly is adjustably positioned along the length of the frame to secure the strikeable martial arts object at different distances or heights above the floor. The martial arts board support device may include a rotational assembly configured to rotate the strikeable martial arts object about an axis. The martial arts board support device may include a tiltable assembly configured to tilt the strikeable martial arts object at an angle to the floor. These features generally provide for changing or adjusting the position of the strikeable martial arts object or board to adapt to different types of strikes an individual may use on the board and/or different individuals (e.g., size, strength, etc.) who may strike the board.

The strikeable martial arts objects that are held, supported and/or positioned by the martial arts support device may be of various types. For example, the strikeable martial arts object may be a board. Exemplary boards include, without limitation, wooden boards and plastic boards. A wooden board may not be reusable after an individual strikes and breaks it. Plastic boards may be specifically designed for the martial arts. These boards may be designed to "break" in a specific area. After the boards break, they may be put back together so that they can be broken again. Boards like this may be called reusable boards. Boards of this type may include, for example, boards like those described in U.S. Pat. Nos. 5,131,896, 5,196,249, 5,204,151 and 5,567,496. One example reusable board has hinges or joints along which the board "breaks" when a striking force is applied. In some designs of this type, a striking force of a certain amount may be needed for the hinge or joint to break. In one example, a reusable board may require a relatively low or small force in order to break. This board may be broken, for example, by a child. In one example, a reusable board may require a relatively high or large force in order to break. This board may be broken, for example, by an adult who is experienced in martial arts. Other types of martial arts objects or boards may be used in the device.

In one embodiment, the support assembly of the martial arts board support device is configured to allow rapid removal and reinsertion of a board. This feature generally may provide for speed and convenience in preparing the device with a new board in the device to minimize waiting of individuals who desire to strike the boards or other objects.

In one embodiment, the support assembly may be configured to release or aid in the release of the strikeable martial arts object from the martial arts board support device when the strikeable object is struck with at least a minimum force. In one embodiment, the striking force needed to release the strikeable martial arts object may be adjustable. The support assembly may be configured to absorb energy applied to a board or other object by an individual striking the object. Hinges or other components may be used to configure the martial arts board support device in this way.

In one embodiment, the martial arts device may be configured to be rapidly and conveniently disassembled, partially disassembled and/or folded for purposes of transporting the device. Generally, the disassembly and/or folding results in the device occupying less space than in the assembled and/or unfolded configuration. For example, the device may be configured so that the support assembly may be detached from the frame. The support assembly may be disassembled further. For example, a rotational assembly and/or tiltable assembly may be detached from the support assembly, or from the frame. One or more of the support assembly, frame, and other attached assemblies may be configured to be folded.

Figure 1A:
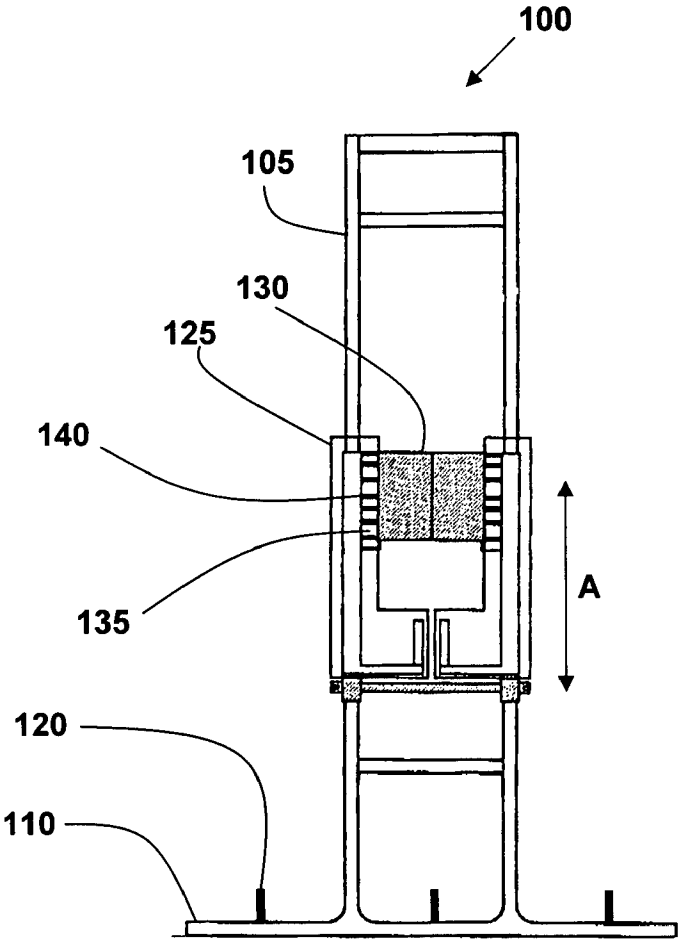

FIGS. 1A and 1B illustrate front and side views, respectively, of one embodiment of a martial arts support device 100. In this embodiment, the martial arts support device 100 includes a frame 105 and a base 110 attached to the frame 105. The base 110 generally may be configured to contact a floor and to support the frame 105 of the device 100 on the floor. In the illustrated embodiment, the frame 105 extends in a vertical direction up from the floor.

As shown in the embodiment illustrated in FIG. 1B, the frame 105 and/or base 110 includes one or more wall supports 115. The wall supports 115 contact a wall when the device 100 is positioned proximal to a wall. The wall supports 115 may provide support for and/or stabilization of the device 100 against the wall when an individual strikes a martial arts object that is secured to the device 100. In the illustrated embodiment, the wall supports 115 are configured to contact a wall, but are not configured to be fixedly connected to a wall. In an alternative embodiment (not shown), the martial arts support device includes wall supports that are configured to be fixedly attached to a wall by at least one attaching member. Exemplary attaching members include, without limitation, suction cups, bolts, screws, nails, epoxy, glue, and other known attaching means. In another alternative embodiment (not shown), the device does not include wall supports and is instead configured to be free standing.

In one embodiment, the device 100 includes one or more weight holders 120. The weight holders 120 generally may be attached to the base 110 and/or frame 105 of the device 100. The weight holders 120 are configured to secure weights to the device 100 and thus facilitate stabilizing the device 100 on the floor. The weight holders 120, for example, may be bars or pegs attached to the frame 105 and/or base 110 onto which standard barbell plates may be secured. In alternative embodiments (not shown), other configurations of weight holders and weights may be used. In another alternative embodiment (not shown), the martial arts support device is configured to be fixedly attached to a floor by at least one attaching member. Exemplary attaching members include, without limitation, bolts, screws, nails, epoxy, glue, and other known attaching means.

In another embodiment (not shown), the martial arts support device does not include a base. Instead, the frame is fixedly attached to a wall by attaching members.

With continued reference to FIG. 1, the martial arts support device 100 includes a support assembly 125. Generally, the support assembly 125 secures a strikeable martial arts object 130 to the device 100. The strikeable martial arts object 130 may be secured to the device 100 in various ways. In the illustrated embodiment, the support assembly includes grooves 135 into which knobs or pins 140 that are part of the strikeable martial arts object 130 are inserted. In alternative embodiments (not shown), clamps, screws, or other known securing means may be employed.

The support assembly 125 generally positions a strikeable martial arts object 130 so that an individual may strike the object. In the illustrated embodiment, the support assembly 125 is slideably positionable along the height of the frame 105, in the directions indicated by arrow A in FIG. 1A. This facilitates positioning of a strikeable martial arts object at different distances from the floor for individuals of different heights and for different exercises (i.e. a low kick, a high punch, etc.).

The support assembly 125 may facilitate rapid board replacement and may facilitate release or removal of the strikeable martial arts object 130 from the device 100, as when the object is struck with at least a minimum force. Examples of this are described below.

In operation of the device 100 illustrated in FIG. 1, striking of a martial arts object 130 that is secured by the device 100 may cause the object 130 to break. In one example, breaking the object may result in the object falling out of and/or away from and/or being released by the device 100. In use of the device 100 illustrated in FIG. 1, striking the object 130 may result in the knobs 140 of the object 130 sliding out of the grooves 135 of the device 100.

In the illustrated embodiment, the martial arts object 130 is a board. Exemplary boards include wooden boards and reusable boards. In alternative embodiments (not shown), the support assembly may support blocks or other strikeable objects.

Figure 2B:
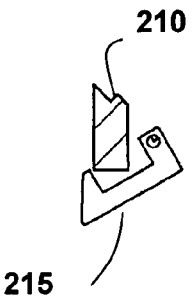
FIG. 2B illustrates a side view of one embodiment of a support clip of a hinged support assembly in an open position.
Figure 2C:
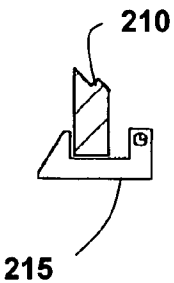
FIG. 2C illustrates a side view of one embodiment of a support clip of a hinged support assembly in a closed position.
Figure 2A:
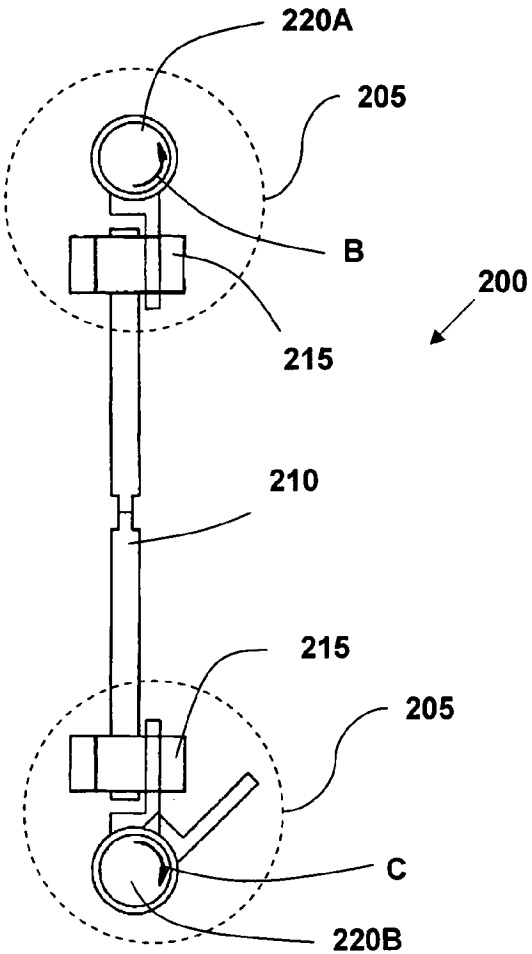
FIG. 2A illustrates a bottom view of one embodiment of a hinged support assembly of a martial arts device.

FIGS. 2A-C illustrate an alternative embodiment by which a support assembly of the device may secure and/or release a strikeable object. FIG. 2A illustrates a bottom view of one embodiment of a hinged support assembly 200 of a martial arts device. The illustrated hinged support assembly 200 includes at least one retainer assembly 205 configured to releasably retain a martial arts object, such as a martial arts board 210. In the illustrated embodiment, each retainer assembly 205 includes a support clip 215 that supports and/or secures the bottom of the board 210. In alternative embodiments, support clips 215 may be positioned to secure the top, the bottom, and/or the sides of a strikeable martial arts object.

Support clips 215 generally facilitate easy insertion or attachment of boards into the device and easy exchange of different boards in and out of the device. FIG. 2B illustrates a side view of one embodiment of a support clip 215 in an open position. In the open position, a martial arts object, like the example board 210, can be inserted into the device as shown in the illustration.

FIG. 2C illustrates a side view of one embodiment of a support clip 215 in a closed position. To be positioned in the closed position, the illustrated support clip 215 may be snapped or locked into a position that secures the board to the device. The support clips 215 may be used in a variety of different support assemblies. For example, the support clips 215 may be used in support assemblies that include hinges (as described below) and in support assemblies that do not include hinges.

With further reference to FIG. 2A, the illustrated retainer assembly 205 further includes hinged supports 220A,B configured to contact the strikeable martial arts board 210. The hinged supports 220A,B are pivotably positionable between a closed position and an open position. In FIG. 2A, hinged support 220A is shown in a closed position and hinged support 220B is shown in an open position (see arrows B and C illustrating direction of pivot).

In one embodiment, the hinged supports 220A,B are positioned in an open position when the support clips 215 are positioned in an open position. This facilitates insertion of a board 210 into the device, as shown and previously discussed in relation to FIG. 2B. When the board 210 is snapped into place by movement of the support clips 215 to a closed position, as illustrated in FIG. 2C, the hinged supports are positioned in a closed position. In one embodiment, the hinged supports may be spring loaded, thereby facilitating movement of the hinged supports from an open to a closed position when the support clips 215 are closed. The hinged supports in the closed position facilitate securing and positioning of the board 210 in the device.

In one embodiment, the hinged supports 220A,B are spring loaded, such that the force of a spring biases the hinged support 220A,B to a closed position and a minimum force is required to pivot the hinged support 220A,B to an open position. In this embodiment, the hinged support 220A,B is not locked in a closed position, but is instead configured to move to an open position as a minimum striking force is applied to a board 210 secured by the device. This configuration may facilitate absorption and/or dissipation of energy that is applied to the board during the strike. Pivoting of the hinged supports 220A,B between a closed position and an open position may also facilitate the martial arts object 210 in being released from the device. In one embodiment, the support clips 215 are configured to open concurrently with the hinged supports 220A,B, thus allowing the board 210 to fall from the releasable retainers 205 after the board is struck. In this embodiment, the user does not need to remove the board, thus a new board can be rapidly inserted.

The hinged supports may have a variable and/or adjustable resistance. In one embodiment, spring-loaded hinged supports can be adjusted to vary the resistance needed to move the supports from a closed to open position. These variable spring-loaded supports are known as torque-variable hinges or latches. Through a tension adjustment, the resistance of the springs may be increased or decreased, thereby increasing or decreasing the striking force applied to the martial arts board and needed to move the hinged supports from a closed to an open position. This adjustable resistance may facilitate adjustment of the device for use by individuals of different ages, strengths, and the like.

In an alternative embodiment, when a hinged support is in the closed position and securing a board 210, a striking force applied to the board 210 does not result in the hinged support moving to the open position. In this embodiment, the hinged support is designed to secure the board 210 during application of a striking force, yet is configured to be moved into the open position by an operator who desires to remove the board 210 from the device. To accomplish this, the hinged supports may be configured to be locked in the closed position and be unlocked to move to the open position. This generally facilitates secured positioning of the board in the device.

It should be recognized that use of clips and/or hinges are but one way by which a strikeable martial arts object may be secured and/or released from a support device. In alternative embodiments (not shown), the martial arts board support does not employ clips, but instead employs alternative retaining members. Exemplary retaining members include pins, adhesive, VELCRO, slots, a vacuum grip, or any other known retaining members.

In various embodiments, the martial arts support device may provide for adjustable positioning of the strikeable martial arts object at different distances from the floor, as described above, and/or for rotational positioning of the martial arts object, tiltable positioning of the martial arts object, and other adjustment.

Figure 3:
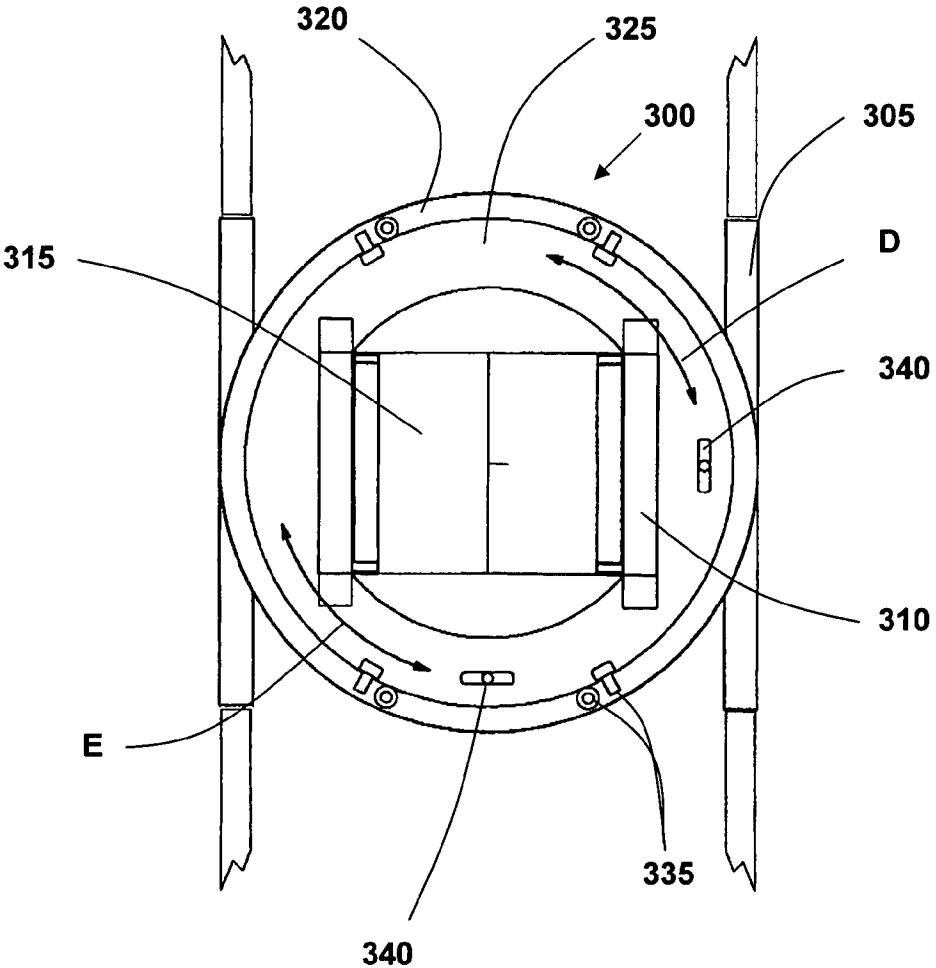
FIG. 3 illustrates a front view of one embodiment of a rotatable assembly.

FIG. 3 illustrates a front view of one embodiment of a rotatable or rotational assembly 300. In this embodiment, a rotatable assembly 300 is connected to the frame 305 of the martial arts support device. The rotatable assembly 300 is also connected to a support assembly 310, the support assembly securing a strikeable martial arts object, like the illustrated board 315. In the illustrated example, the rotatable assembly has a back plate 320 attached to a front plate 325. In the illustrated example, the back plate 320 is attached to the frame 305 and the front plate 325 is attached to the support assembly 310. In the illustrated example, the front plate 325 may rotate in the directions shown by arrows D and E. Rollers 335 attached to one or both of the back plate 320 and the front plate 325 may facilitate smooth and/or stable rotation. Rotation of the front plate 325 may facilitate positioning of the strikeable martial arts board 315 for ease of striking by an individual. For example, if a reusable board is used, the reusable board may be rotated such that a seam of the board is optimally positioned for the type of kick, punch, etc. being attempted. Once the martial arts board is rotated to the desired position, locking pins 340 may be used to stop further rotation and secure the board 315 in the desired position.

In alternative embodiments (not shown), the device includes a tiltable assembly. The tiltable assembly may be connected to the frame of the martial arts support device. The tiltable assembly may be configured to position the striking face of a board, for example, at various angles with respect to the floor and/or an individual who may desire to strike the board. This positioning may provide for ease of striking the board by the individual.

Figure 4:
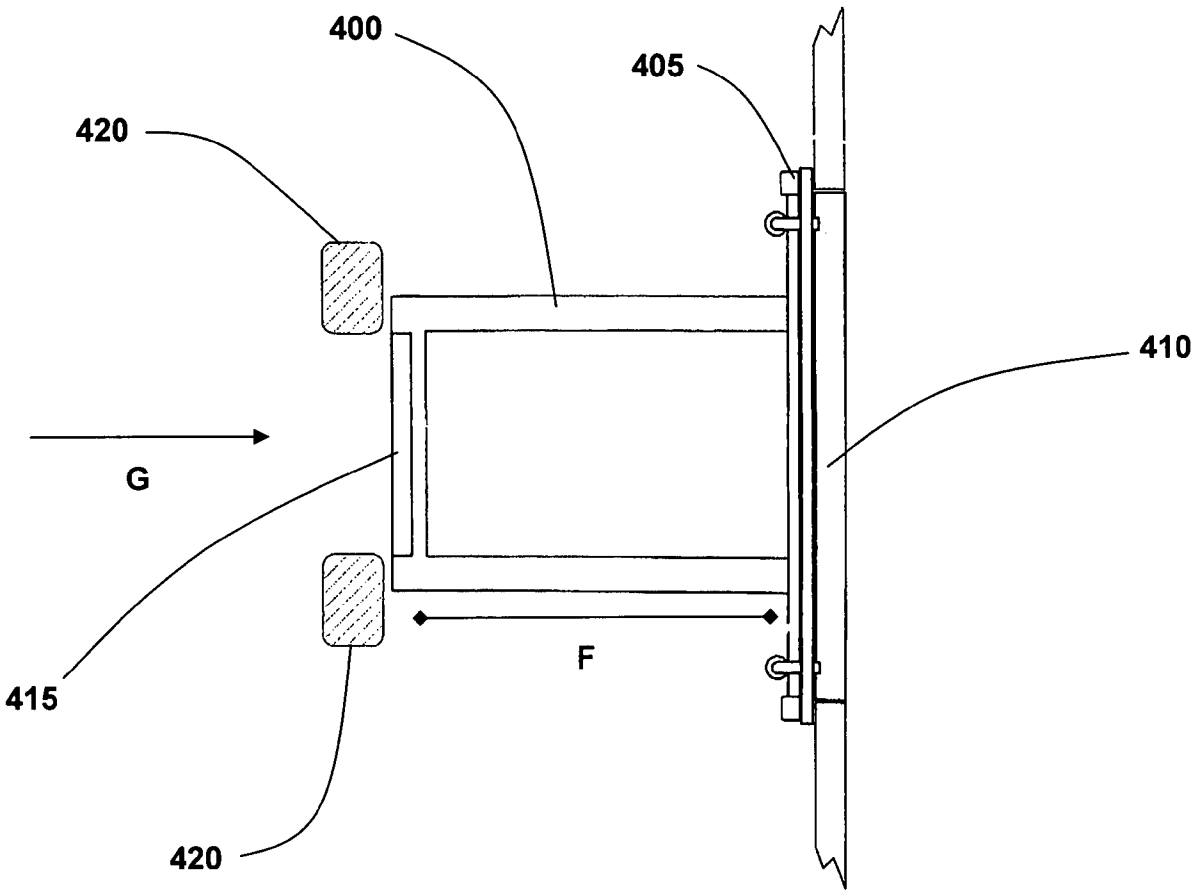
FIG. 4 illustrates a top or bottom view of one embodiment of a padded board support assembly attached to an example rotatable assembly attached to an example frame.

FIG. 4 illustrates a top or bottom plan view of one embodiment of a padded support assembly 400 attached to an example rotatable assembly 405 attached to an example frame 410. In the illustrated example, the support assembly 400 positions a strikeable martial arts board 415 at a distance F from the frame 410. An individual may attempt to strike the board 415 along the direction of arrow G. Pads 420 are positioned around the board 415 to prevent or reduce injuries to an individual who may be off target and miss the board 415 when attempting to strike the board 415.

Figure 5B:
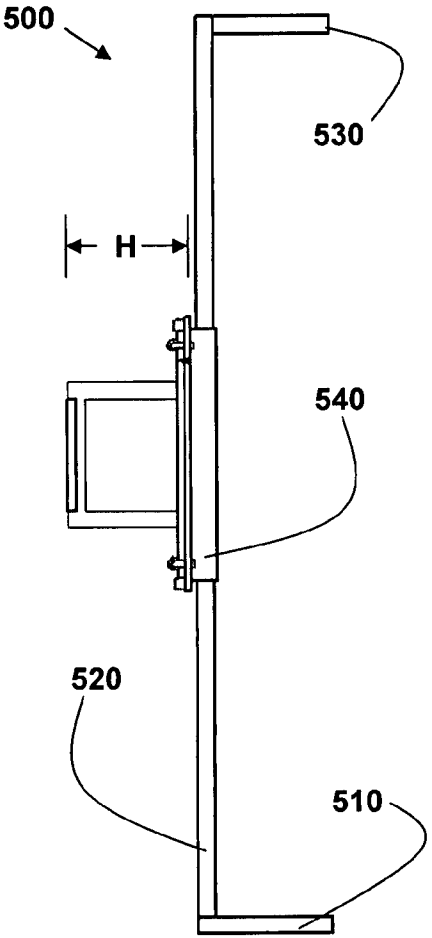
FIGS. 5A, 5*b* illustrate front and side views of one embodiment of a martial arts device.
Figure 5A:
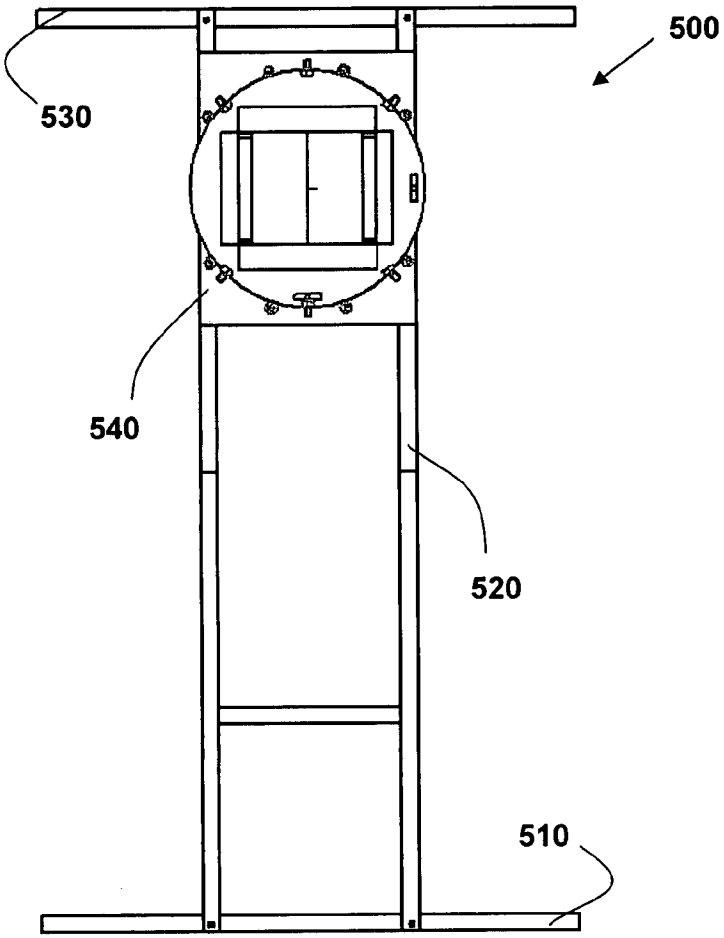

FIGS. 5A,B illustrate front and side views, respectively, of another embodiment of a martial arts support device 500. In this embodiment, the device 500 is modular and portable. The device 500 includes a base 510, a frame 520, a wall support 530 and a support assembly 540. As shown, the support assembly 540 is configured to be slidably positioned at different heights along the frame 520.

In the illustrated embodiment, the support assembly 540 is a rotational support assembly, similar to the rotational support assembly illustrated in FIG. 3. In an alternative embodiment (not shown), the support assembly is tiltable. In another alternative embodiment (not shown), the support assembly is non-rotatable.

With continued reference to FIGS. 5A,B, the support assembly 540 is configured to support a martial arts object at a fixed distance G from the frame 520. In alternative embodiments (not shown), the support assembly may support a martial arts object such that it is co-planar with the frame.

Figure 6:
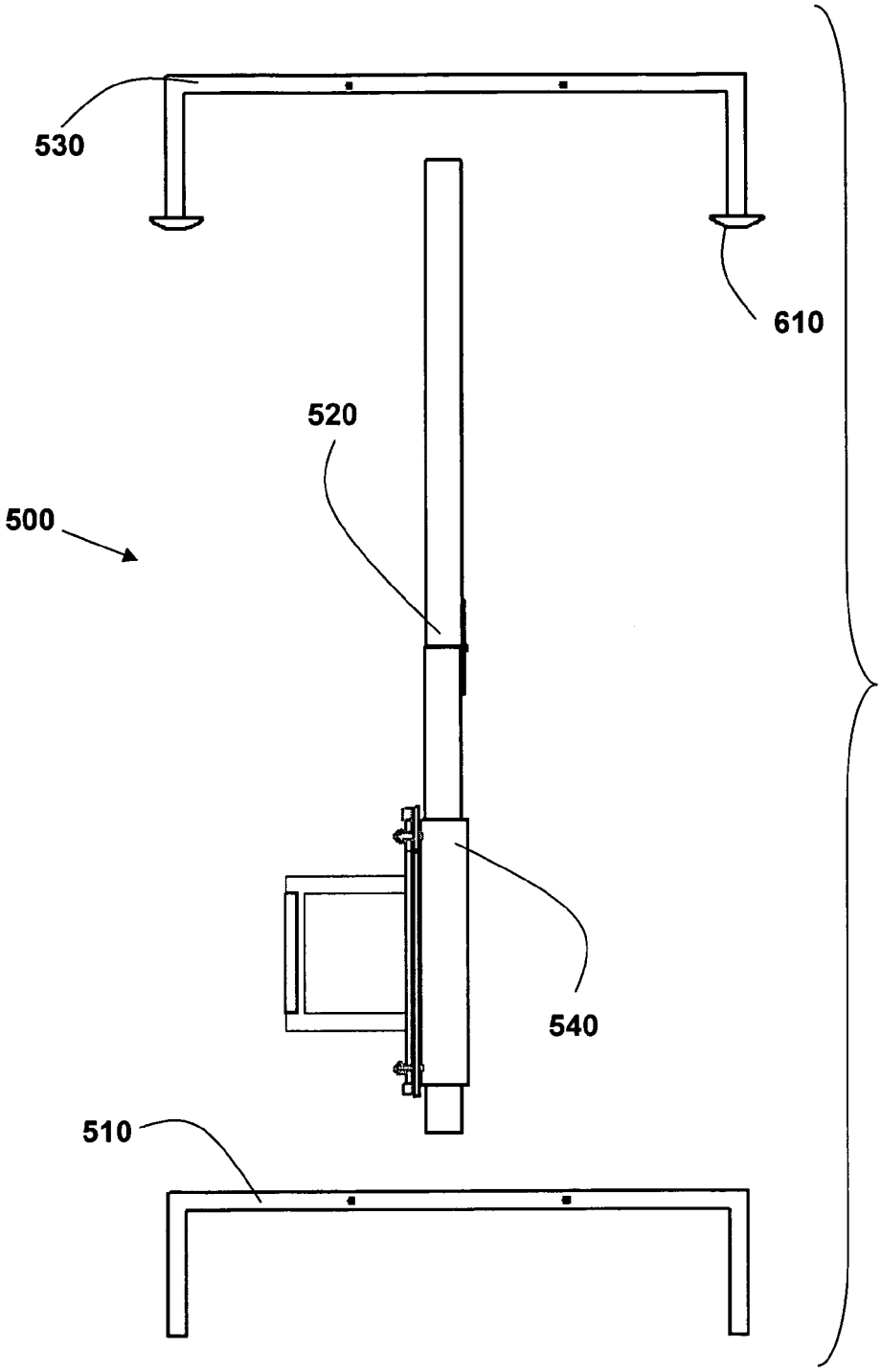
FIG. 6 illustrates one embodiment of a martial arts device in a partially disassembled state.

FIG. 6 illustrates the martial arts support device 500 in a partially disassembled state. In this embodiment, the base 510 and the wall support 530 is configured to be removably connected to the frame 520. The base 510 and the wall support 530 may be connected to the frame 520 via pins, slotted openings, screws, bolts, or any known connectors. Thus, in this embodiment, when the device 500 is not in use, it may be disassembled for storage or transportation.

In the embodiment illustrated in FIG. 6, the wall support 530 includes a stopper 610 configured to abut a wall. The stopper may be constructed of rubber to prevent damage from occurring to the wall. In an alternative embodiment (not shown), the wall support includes suction cups or other fixing means to fix the wall support to a wall.

Figure 7B:
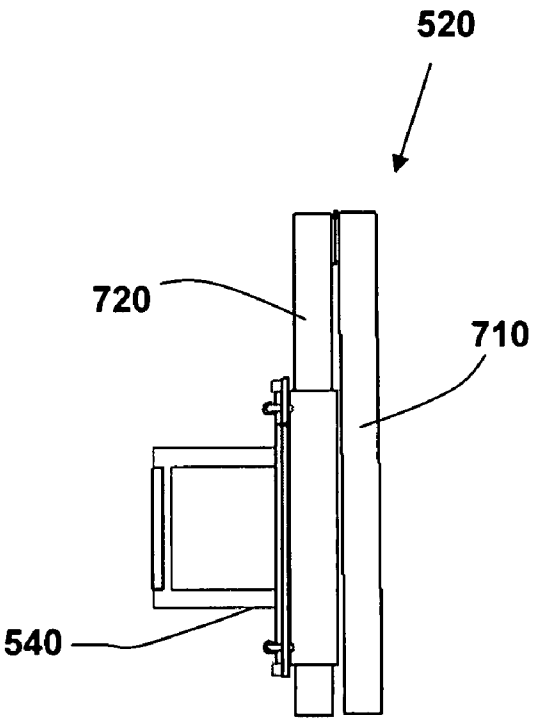
FIG. 7B illustrates one embodiment of a frame of a martial arts device in a folded position.
Figure 7A:
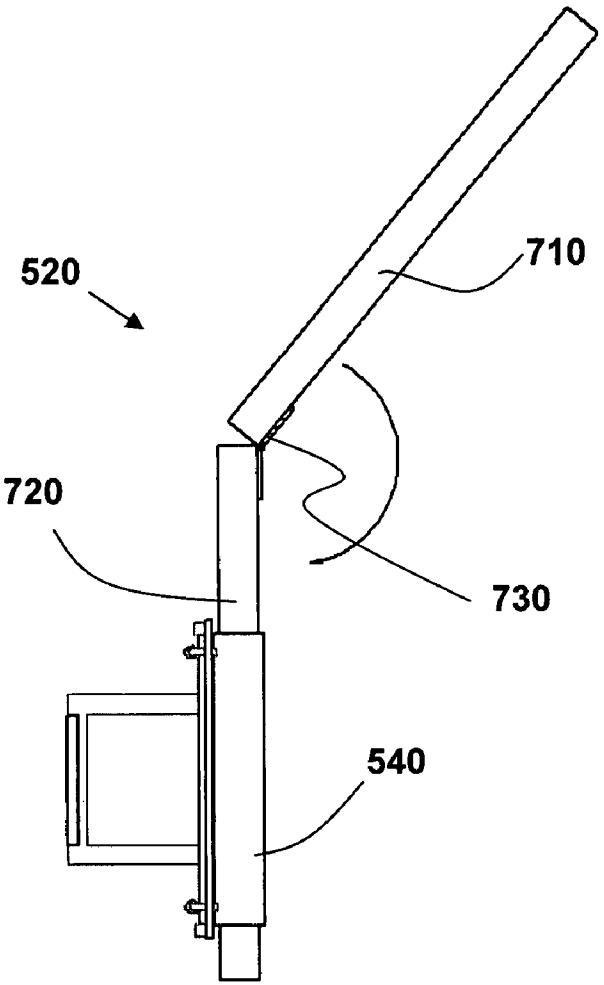
FIG. 7A illustrates one embodiment of a frame of a martial arts device.

FIGS. 7A,B illustrate side views of the frame 520 and the support assembly 540. As shown in FIG. 7A, in this embodiment, the frame 520 includes at least an upper portion 710 and a lower portion 720 connected by a hinge 730. The frame 520 is thus configured to be folded in a direction indicated by arrow H from an upright position (as shown in FIGS. 5,6) to a downward storage position (as shown in FIG. 7B). To fold the frame 520, the support assembly 540 must be positioned completely on the upper portion 710, completely on the lower portion 720; or removed from the frame 520 entirely. The frame may optionally include one or more locking mechanism (not shown), such as a sleeve, a pin, a bolt, or other known locking means, to lock the frame in one of the above mentioned positions. The frame may also optionally include a handle and one or more wheels to facilitate transportation.

In an alternative embodiment (not shown), the frame may be configured to fold in an opposite direction. In another alternative embodiment (not shown), the frame may include three or more portions connected by hinges such that the frame may be folded two or more times.

In yet another alternative embodiment (not shown), the frame does not include a hinge, but instead includes at least two portions configured to be removably connected to each other. The at least two portions may be connected via bolts, pins, sleeves, screws, or any other known connecting means.

FIGS. 8A-D illustrate the modular components of the device 500 in a disassembled state.

Figure 8D:
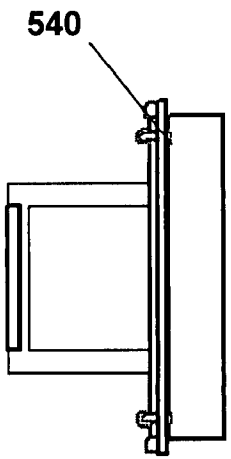
FIGS. 8A-D illustrate one embodiment of a martial arts device in a fully disassembled state.
Figure 8C:
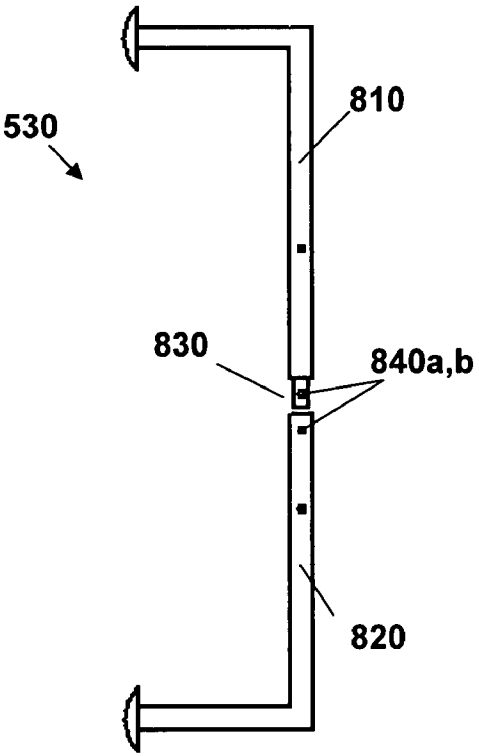
Figure 8B:
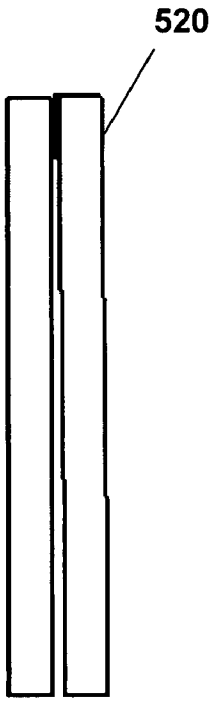
Figure 8A:
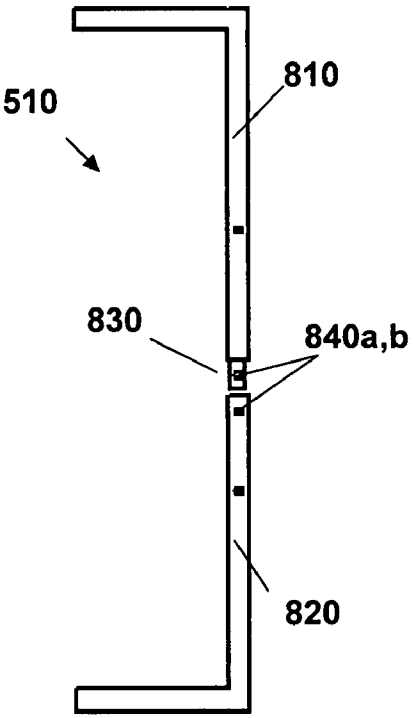

FIG. 8A illustrates the base 510. As shown in the illustrated embodiment, the base 510 includes at least two portions, including a first portion 810 and a second portion 820, configured to be removably attached to each other. The first portion 810 includes a peg 830 configured to be inserted into an aperture (not shown) of the second portion 820. The peg 830 and the second portion 820 each include corresponding apertures 840*a,b* configured to receive a locking mechanism (not shown). When the peg 830 is inserted into the aperture of the second portion 820, the corresponding apertures 840*a,b* may be aligned to receive the locking mechanism. Exemplary locking mechanisms include pins, screws, bolts, ties, and other known locking mechanisms. In an alternative embodiment (not shown), the first portion includes a threaded peg and the second portion includes a threaded aperture, such that the threaded peg may be screwed into the threaded aperture. In another alternative embodiment (not shown), a sleeve may be configured to cover the ends of the first portion and second portion. The sleeve and the first and second portion may each have corresponding apertures configured to receive locking mechanisms to lock the sleeve in place.

As shown in FIG. 8A, the first portion 810 and the second portion 820 of the base 510 are each generally L-shaped. Thus, when the base 510 is assembled, the base 510 is generally C-shaped. In an alternative embodiment (not shown), the first portion and the second portion are each generally C-shaped, such that when the base is assembled, it is generally E-shaped.

FIG. 8B illustrates the frame 520 folded in a downward storage position.

FIG. 8C illustrates the wall support 530. As shown in the illustrated embodiment, the wall support 530 includes at least two portions, including a first portion 850 and a second portion 860, configured to be removably attached to each other. The first portion 850 includes a peg 870 configured to be inserted into an aperture (not shown) of the second portion 860. The peg 870 and the second portion 860 each include corresponding apertures 880*a,b* configured to receive a locking mechanism (not shown). When the peg 870 is inserted into the aperture of the second portion 860, the corresponding apertures 880*a,b* may be aligned to receive the locking mechanism. Exemplary locking mechanisms include pins, screws, bolts, ties, and other known locking mechanisms. In an alternative embodiment (not shown), the first portion includes a threaded peg and the second portion includes a threaded aperture, such that the threaded peg may be screwed into the threaded aperture. In another alternative embodiment (not shown), a sleeve may be configured to cover the ends of the first portion and second portion. The sleeve and the first and second portion may each have corresponding apertures configured to receive locking mechanisms to lock the sleeve in place.

As shown in FIG. 8C, the first portion 850 and the second portion 860 of the wall support 530 are each generally L-shaped. Thus, when the wall support 530 is assembled, the wall support 530 is generally C-shaped. In an alternative embodiment (not shown), the first portion and the second portion are each generally C-shaped, such that when the wall support is assembled, it is generally E-shaped.

FIG. 8D illustrates a support assembly 540 removed from the frame 520.

In any embodiment, the device generally may be made from materials that provide a sturdy and durable design. For example, all or part of the device may be made from various metals, various plastics, wood, and the like.

While example devices have been illustrated by describing examples, and while the examples have been described in considerable detail, it is not the intention of the applicants to restrict or in any way limit the scope of the appended claims to such detail. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

The invention claimed is:

1. A modular device for securing a strikeable martial arts object, comprising:

a base;

a hinged frame configured to be removably connected to the base;

at least one support member configured to be removably connected to the hinged frame;

an object support assembly configured to be adjustably positioned along the hinged frame; and at least two retainers, including a first retainer and a second retainer, wherein the first retainer is pivotally connected to the object support assembly about a first substantially vertical axis and the second retainer is pivotally connected to the object support assembly about a second substantially vertical axis substantially parallel to the first substantially vertical axis, wherein the at least two retainers are configured to accept and retain a single strikeable martial arts object, and wherein the at least two retainers are configured to move and disengage the single strikeable martial arts object when at least a minimum force is applied to the single strikeable martial arts object.

2. The device of claim 1, wherein the hinged frame includes at least a lower portion and an upper portion configured to pivot from an upright position to a downward position.

3. The device of claim 1, wherein the object support assembly includes at least two modular components.

4. The device of claim 1, wherein the object support assembly is removably connected to the hinged frame.

5. The device of claim 1, further including a handle and wheels.

6. The device of claim 1, wherein the at least one retainer includes a pair of lower hinged support clips, each lower hinged support clip having a groove and being positioned to engage a bottom surface of the strikeable martial arts object and a pair of upper hinged supports, each upper hinged support having a substantially L-shaped member and being positioned to engage a rear surface of a strikeable martial arts object.

7. A device for securing a martial arts object, comprising:

a frame;

a support assembly connected to the frame; and at least one pair of pivotal retainers arranged substantially parallel to each other, each pivotal retainer including a vertical support member connected to the support assembly by a vertical hinge, wherein each pivotal retainer is configured to secure a martial arts object to the device and each vertical support member is configured to pivot about a corresponding vertical hinge and release the martial arts object when a minimum force is applied to the martial arts object.

8. The device of claim 7, wherein the support assembly is configured to rotate the martial arts object.

9. The device of claim 7, wherein the support assembly is configured to tilt the martial arts object.

10. The device of claim 7, wherein the martial arts object is a reusable martial arts board.

11. The device of claim 7, wherein the martial arts object is a wooden board.

12. The device of claim 7, wherein the support assembly is padded and is configured to secure the martial arts object a fixed distance from the frame.

13. The device of claim 7, wherein the at least one retainer includes a pair of lower hinged support clips, each lower hinged support clip having a groove and being positioned to engage a bottom surface of the martial arts object and a pair of upper hinged supports, each upper hinged support having a substantially L-shaped member and being positioned to engage a rear surface of a martial arts object.

14. A device for securing a martial arts object, comprising:

a frame;

a support assembly connected to the frame; and means for retaining a martial arts object and releasing the martial arts object when the martial arts object is struck with at least a minimum force, including means for rotating along a pair of vertical axes.

* * * * *